US006066003A

United States Patent [19]

Chang

[11] Patent Number: 6,066,003

[45] Date of Patent: May 23, 2000

[54] BLIND MATE CONNECTOR

[75] Inventor: Yao-Hao Chang, Tu-Chen, Taiwan

[73] Assignee: Hon Hai Precision Ind. Co., Ltd., Taipei Hsien, Taiwan

[21] Appl. No.: 09/337,363

[22] Filed: Jun. 21, 1999

[30] Foreign Application Priority Data

Dec. 28, 1998 [TW] Taiwan ..... 87221632

[51] Int. Cl.[7] ..... H01R 13/648

[52] U.S. Cl. ..... 439/607; 439/573; 439/939

[58] Field of Search ..... 439/374, 607, 439/939, 573, 67

[56] References Cited

U.S. PATENT DOCUMENTS 5,709,569 1/1998 Buck et al. ..... 439/607

5,725,386 3/1998 Davis et al. ..... 439/607

*Primary Examiner*—Gary F. Paumen

*Attorney, Agent, or Firm*—Wei Te Chung

[57] ABSTRACT

A blind connector comprises a dielectric housing, a number of terminals received in the housing and a shield enclosing the housing. The housing comprises a mating portion projecting therefrom with a number of terminal-receiving passageways defined therein for receiving the terminals. The shield comprises a shroud for enclosing the mating portion of the housing and a U-shaped flange for embeddedly engaging with the housing. A periphery of the shroud comprises an outwardly extending bell-mouthed guiding surface for facilitating convenient interconnection between the connector and an external mating connector.

4 Claims, 8 Drawing Sheets

BLIND MATE CONNECTOR

BACKGROUND OF THE INVENTION

The present invention relates to an electrical connector, and more particularly to a blind mate connector located in a PC enclosure for facilitating convenient interconnection with an external mating connector.

DESCRIPTION OF PRIOR ART

As the development of computer technology rapidly progresses, a variety of external peripheral devices is attached to computers for providing additional functions. Electrical connector assemblies are required which securely attach communication cables from such peripheral devices to the computer, and which facilitate convenient insertion, thereby making signal transmission more reliable. The method commonly used to protect against electromagnetic or radio frequency interference (EMI/RFI) is to surround a dielectric housing retaining a plurality of terminals with a grounded conductive shield. The conventional shield of the connector located in a PC enclosure comprises a shroud projecting therefrom which generally has an inwardly extending periphery. Taiwan Patent Application Ser. Nos. 79208314, 80210272 and 82210362 disclose such a design.

Referring to FIG. 1, a conventional blind mate connector has a shroud 8 with an inwardly extending periphery 9. For facilitating insertion of the mating connector, the connector shroud 8 must be retained in alignment with the enclosure opening. This is difficult due to the deflection of the connector shroud 8 relative to the enclosure opening, which results from use and movement of the computer. Therefore, the conventional connector located in the PC enclosure does not promote easy interconnection with the external mating connector because of its inaccurate alignment with the PC enclosure. Hence, a blind mate connector for facilitating easy and convenient interconnection of an external mating connector is desired.

SUMMARY OF THE INVENTION

One object of the present invention is to provide a blind mate connector located in a PC enclosure and behind an opening of the enclosure for facilitating convenient interconnection with an external mating connector.

In order to achieve the object set forth, a blind connector in accordance with the present invention comprises a dielectric housing, a plurality of terminals received in the housing and a shield enclosing the housing. The housing comprises a mating portion projecting therefrom with a plurality of terminal-receiving passageways defined therein for receiving the terminals. The shield comprises a shroud for enclosing the mating portion of the housing. A periphery of the shroud comprises an outwardly extending bell-mouthed guiding surface defining an entry opening which is positioned behind the enclosure opening and generally larger than the enclosure opening, thereby facilitating alignment between the connector shroud and the enclosure opening and thus facilitating guidable and assured convenient interconnection between the connector and the external mating connector.

Other advantages and novel features of the invention will become more apparent from the following detailed description when taken in conjunction with the accompanying drawings.

DETAILED DESCRIPTION OF PREFERRED EMBODIMENTS

Figure 1:
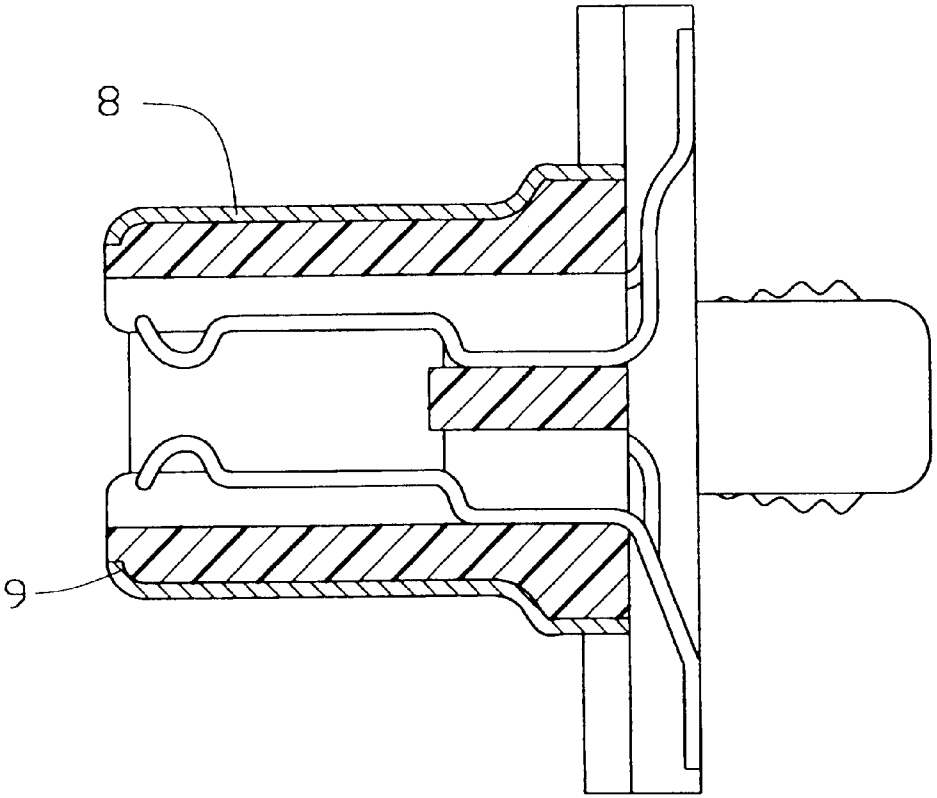
FIG. 1 (PRIOR ART)
FIG. 1 is a vertical cross-sectional view of a conventional blind mate connector.
Figure 2:
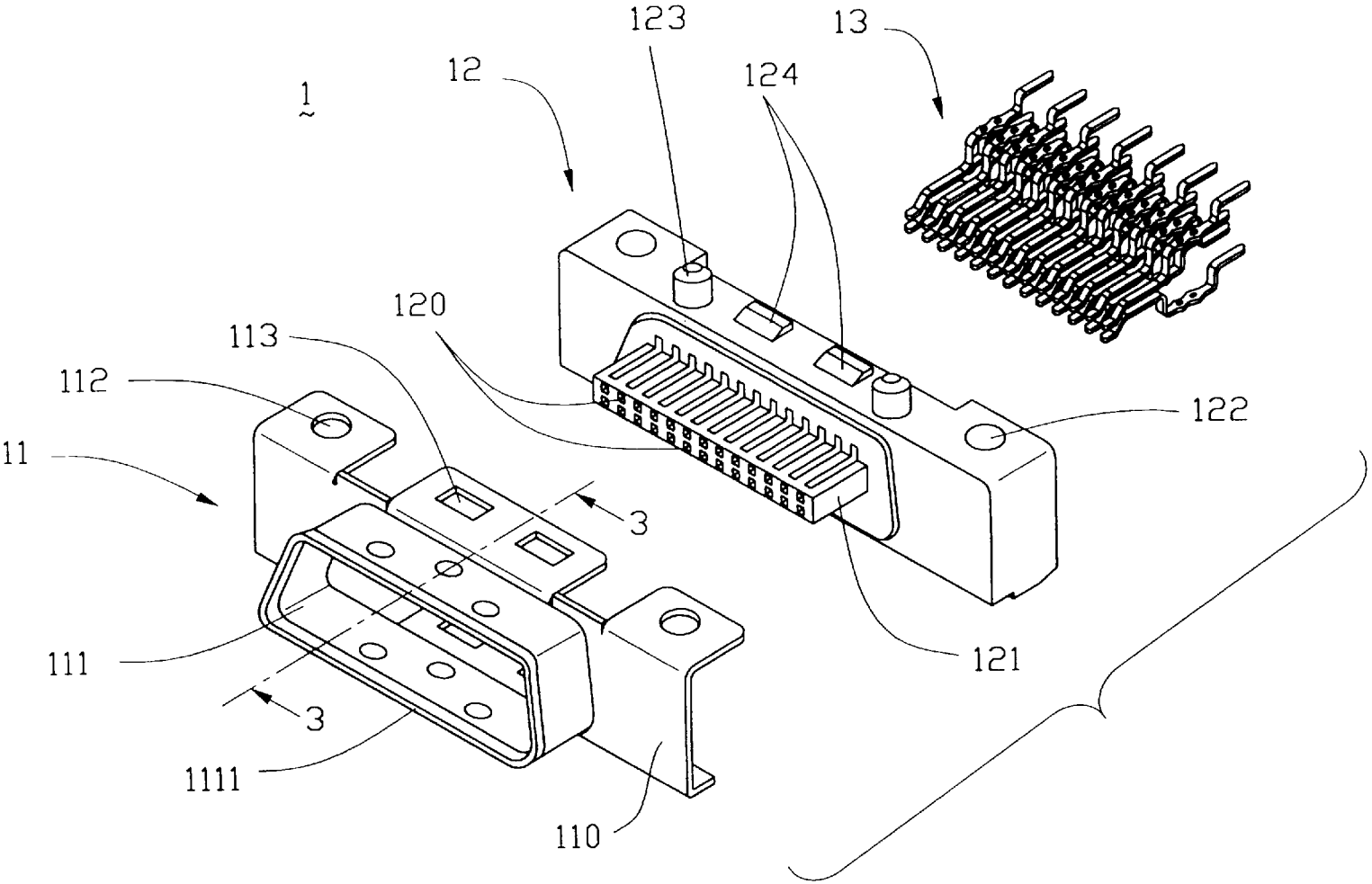
FIG. 2 is an exploded view of a blind mate connector in accordance with a first embodiment of the present invention.

Referring to FIG. 2, a blind mate connector 1 in accordance with a first embodiment of the present invention is located in a PC enclosure 2 (FIG. 7) and connects with an external mating connector (not shown) through an opening (not shown) in the enclosure 2. The connector 1 comprises a shield 11, a dielectric housing 12 and a plurality of terminals 13 received in the housing 12. The housing 12 comprises a mating portion 121 projecting therefrom with a plurality of terminal-receiving passageways 120 defined therein for receiving the terminals 13. A pair of through holes 122 is disposed in opposite sides of the housing 12 with a pair of spaced positioning posts 123 formed therebetween and a pair of latch bosses 124 is formed between the two posts 123.

Figure 3:
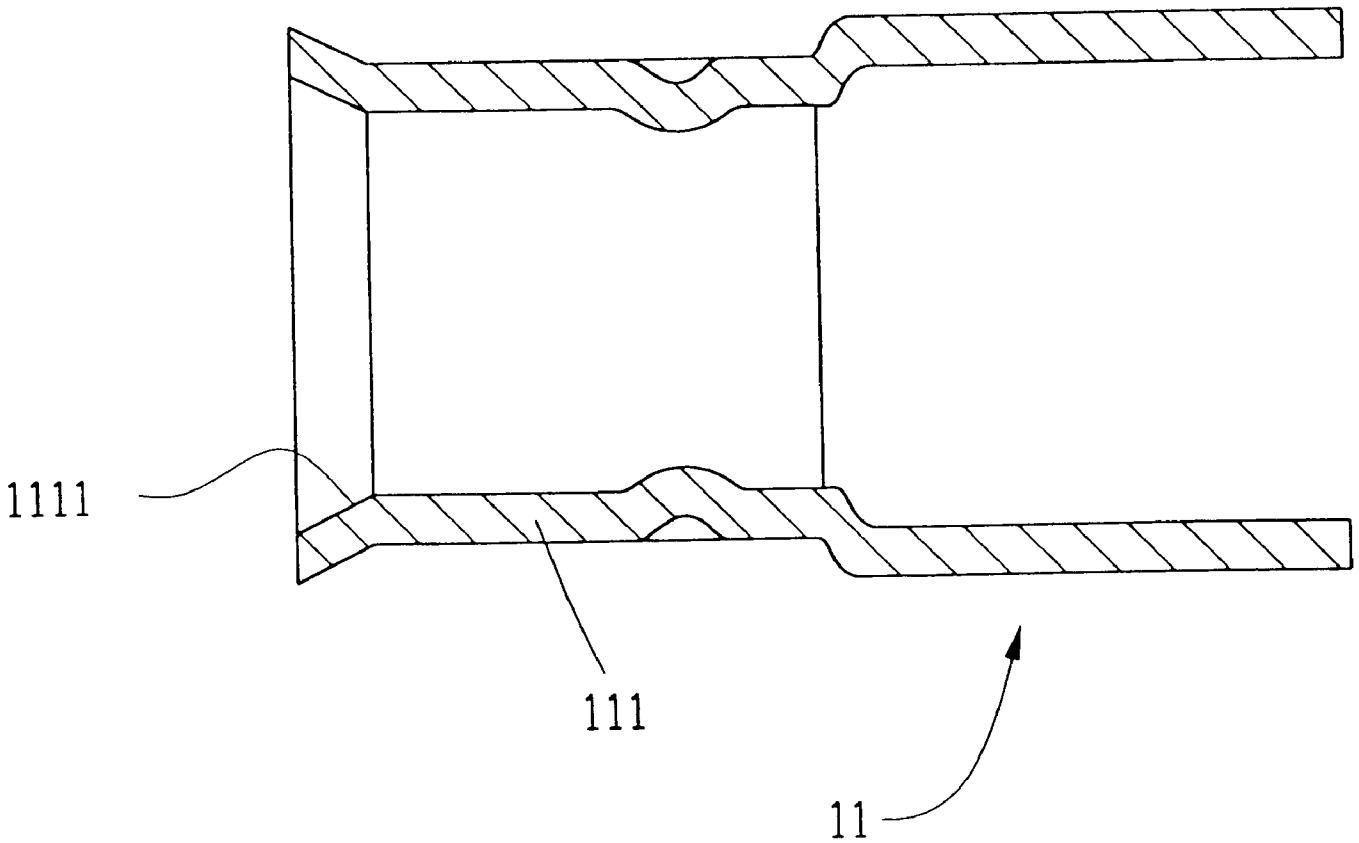
FIG. 3 is a cross-sectional view taken along line 3—3 of FIG. 2.
Figure 4:
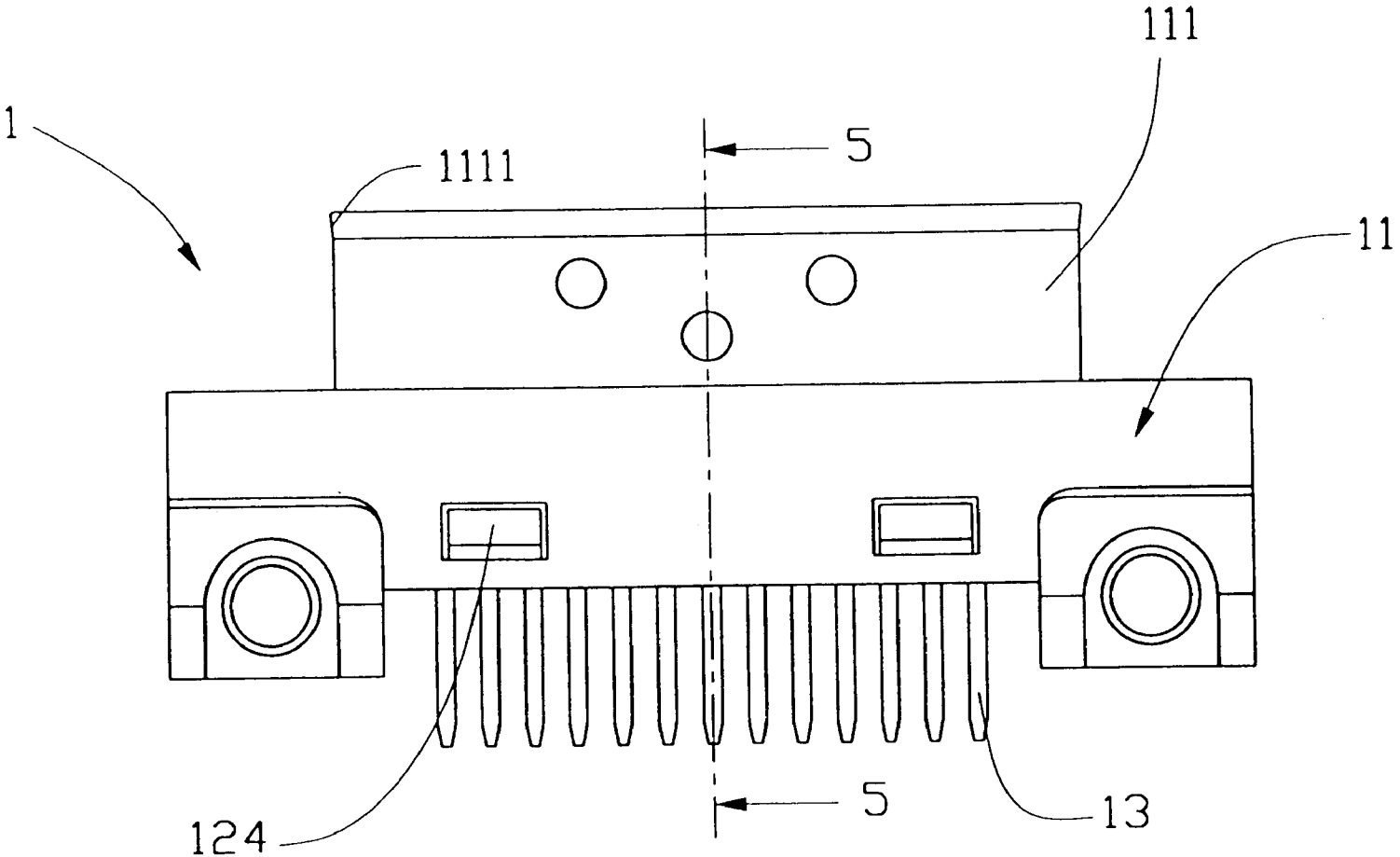
FIG. 4 is a bottom plan view of the assembled blind mate connector in accordance with the first embodiment.
Figure 5:
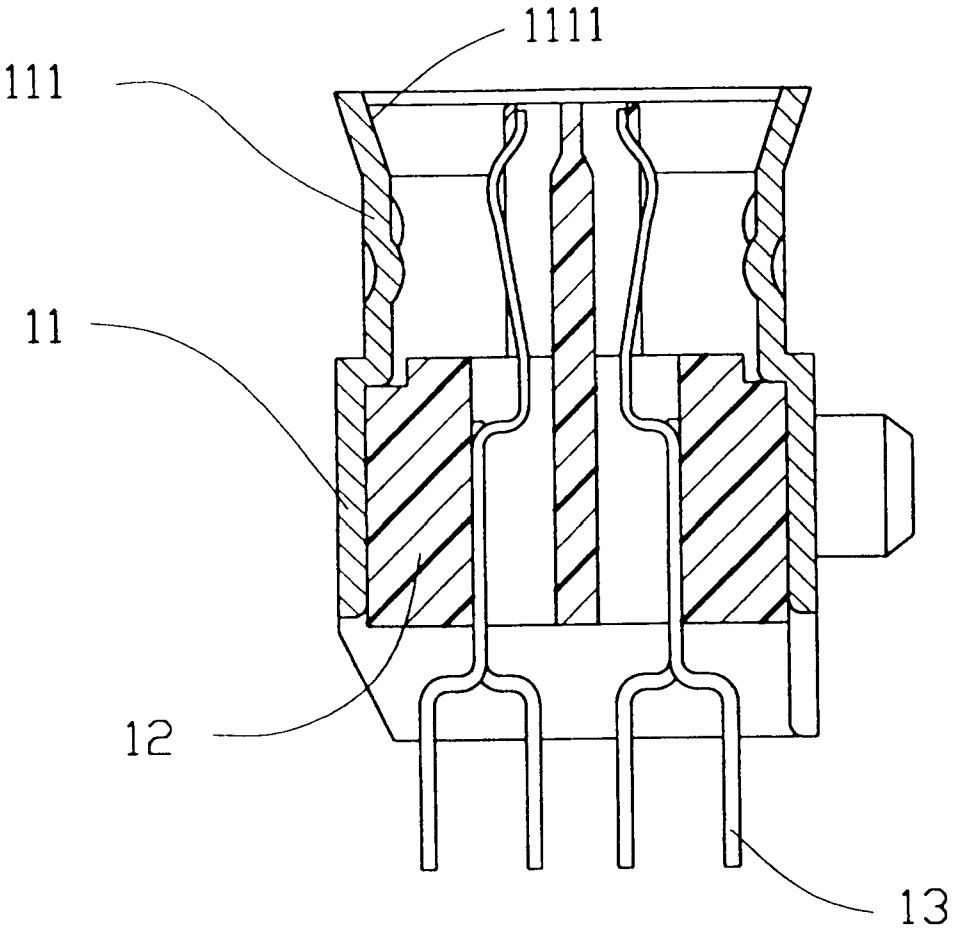
FIG. 5 is a cross-sectional view taken along line 5—5 of FIG. 4.
Figure 6:
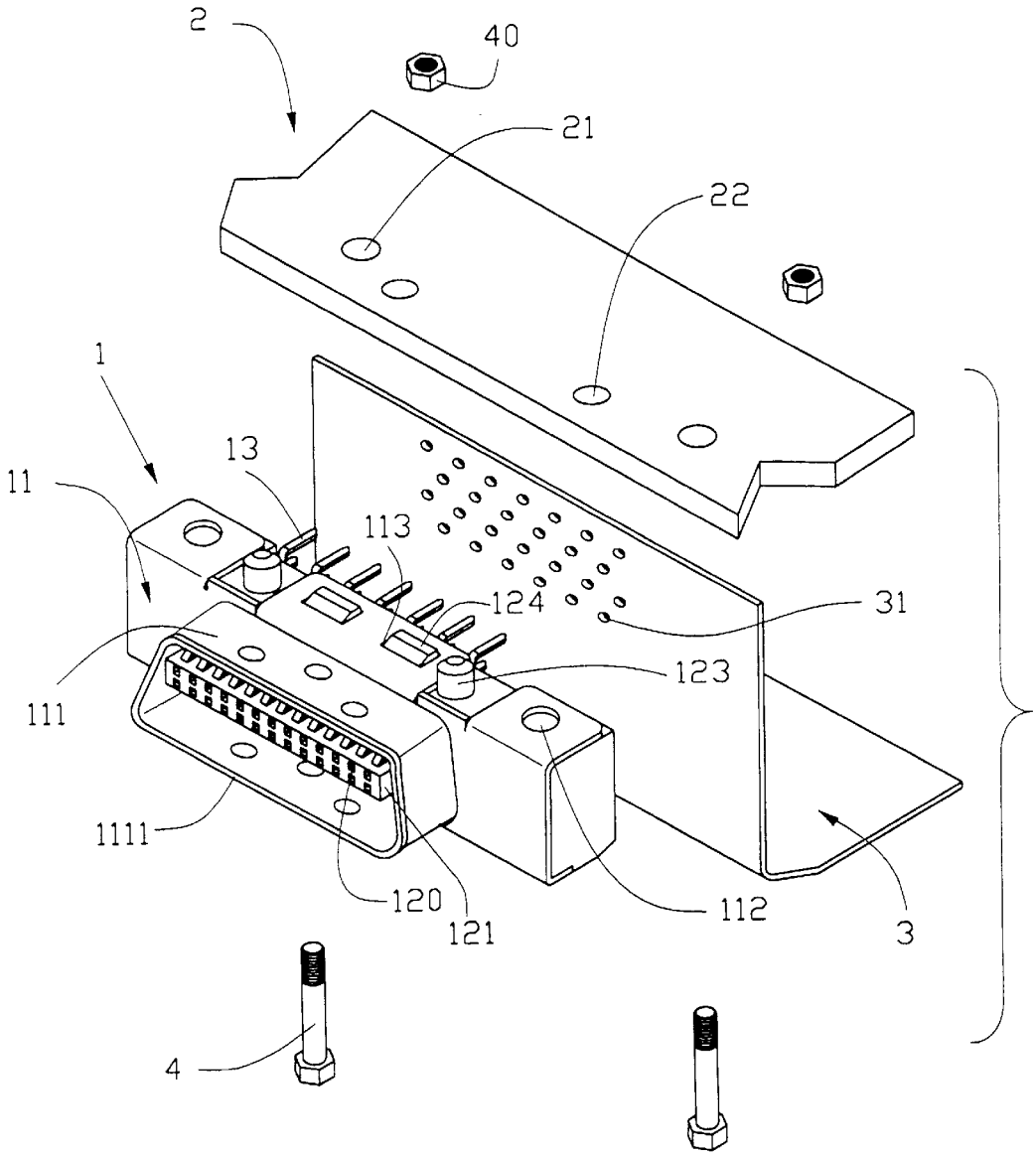
FIG. 6 is an exploded view of the blind mate connector in accordance with the first embodiment, an FPC board and a PC enclosure.

Also referring to FIG. 3, the shield 11 is an integral structure stamped and formed from a metal sheet. The shield 11 comprises a U-shaped flange 110 and a shroud 111 projecting from the flange 110 for enclosing the mating portion 121 of the housing 12. A guiding surface 1111 formed around the periphery of the shroud 111 extends outwardly and forms a bell-mouth. The flange 110 is U-shaped for embeddedly engaging with the housing 12. A pair of apertures 112 is disposed in the flange 110 in alignment with the corresponding through holes 122 of the housing 12 for the extension of bolts 4 (FIG. 6) therethrough. A pair of holes 113 is disposed between the two apertures 112 for engaging with the latch bosses 124 of the housing 12 thereby stabilizing the shield 11 when the housing 12 and the shield 11 are attached to the PC enclosure 2 by means of the bolts 4 and nuts 40 (FIG. 6). FIGS. 4, 5 and 6, show the components of the connector 1 fastened together.

Figure 7:
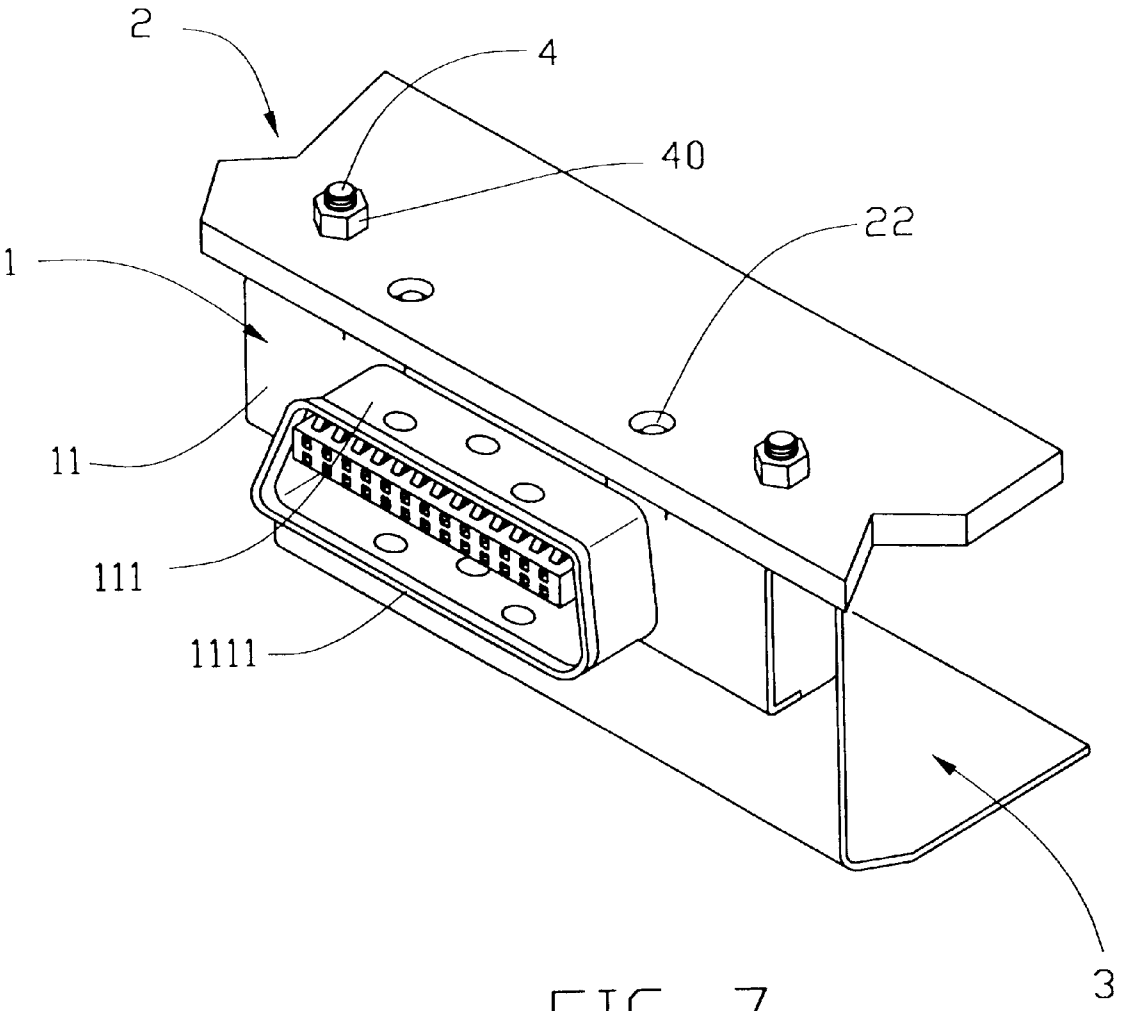
FIG. 7 is an assembled view of FIG. 6.

Referring to FIGS. 6 and 7, a pair of screw holes 21 is disposed in the PC enclosure 2 in alignment with the apertures 112 of the shield 11 and the through holes 122 of the housing 12 for the extension of the bolts 4 therethrough. The enclosure 2 further comprises a pair of positioning holes 22 disposed between the two screw holes 21 corresponding to the two positioning posts 123 of the connector housing 12.

An FPC (Flexible Printed Circuit) board 3 comprises a plurality of openings 31 arranged in rows in a pattern corresponding to the terminals 13 of the connector housing 12. The terminals 13 extend through the corresponding openings 31 of the FPC board 3 thereby connecting the connector 1 with the board 3.

In assembly, the terminals 13 in the connector 1 extend through the openings 31 of the board 3. The screw holes 21 of the PC enclosure 2 align with the apertures 112 of the connector shield 11 and the through holes 122 of the connector housing 12 thereby attaching the connector 1 to the PC enclosure 2 by means of the bolts 4 and the nuts 40. Since the guiding surface 1111 of the connector shroud 111 extends outwardly, the interconnection between the connector 1 and the external mating connector through the enclosure opening is facilitated.

Figure 8:
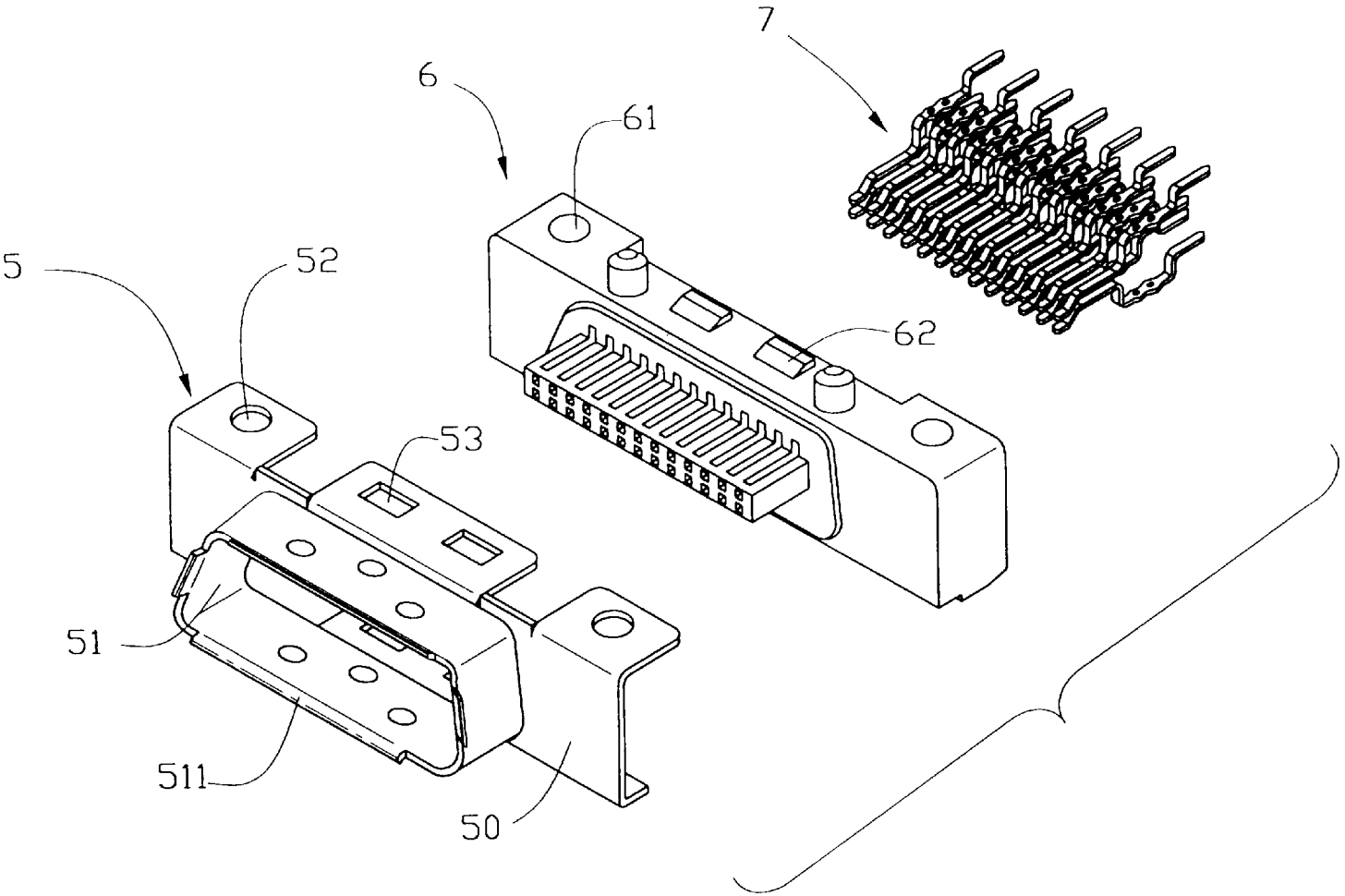
FIG. 8 is an exploded view of a blind mate connector in accordance with a second embodiment of the present invention.

Referring to FIG. 8, a blind mate connector in accordance with a second embodiment of the present invention comprises a shield 5, a dielectric housing 6 and a plurality of terminals 7 received in the housing 6. The configurations of the housing 6 and terminals 7 are similar to that of the first embodiment. A discontinuous four section guiding surface 511 outwardly protrudes in four directions from a connector shroud 51. The other parts of the shield 5 are similar to that of the first embodiment. The end of the shield 5 opposite the shroud 51 is a U-shaped flange 50 for embeddedly engaging with the housing 6. A pair of apertures 52 is disposed in opposite ends of the flange 50 in alignment with through holes 61 of the housing 6. The flange 50 also comprises a pair of holes 53 for engaging with corresponding latch bosses 62 formed on the housing 6 thereby stabilizing the shield 5 when engaging the shield 5 with the housing 6.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A blind mate connector located in and engaged with a PC enclosure for connecting with an external mating connector through an enclosure opening, comprising:

a dielectric housing having a mating portion projecting therefrom with a plurality of terminal-receiving passageways defined therein, and first engaging means for engaging with the enclosure;

a plurality of terminals received in the terminal-receiving passageways and extending rearward from the housing for connecting to a flexible printed circuit board; and a shield comprising a shroud for enclosing the mating portion of the housing and second engaging means for engaging with the enclosure in cooperation with the first engaging means of the housing, the shroud comprising an outwardly extending guiding surface and defining an entry opening slightly larger than the enclosure opening for facilitating reception of the external mating connector;

wherein the enclosure has a pair of screw holes and the first engaging means of the housing comprises a pair of through holes defined in opposite sides of the housing in alignment with corresponding screw holes of the enclosure;

wherein the second engaging means of the shield comprises a pair of apertures in alignment with the through holes of the housing and the screw holes of the enclosure for the extension of bolts therethrough.

2. The blind mate connector as described in claim 1, wherein the periphery of the guiding surface is continuous.

3. The blind mate connector as described in claim 1, wherein the periphery of the guiding surface is discontinuous.

4. The blind mate connector as described in claim 1, wherein the periphery of the guiding surface is divided into four sections.

* * * * *